US006837245B2

(12) United States Patent
Matheny et al.

(10) Patent No.: US 6,837,245 B2
(45) Date of Patent: Jan. 4, 2005

(54) VALVE ASSEMBLY FOR BREATHING SYSTEMS

(75) Inventors: Kim I. Matheny, Leslie, MO (US); Steve R. Pinkston, House Springs, MO (US)

(73) Assignee: Essex Manufacturing Company, St. Louis, MO (US)

( * ) Notice: Subject to any disclaimer, the term of this patent is extended or adjusted under 35 U.S.C. 154(b) by 103 days.

(21) Appl. No.: 10/253,375

(22) Filed: Sep. 24, 2002

(65) Prior Publication Data

US 2004/0000312 A1 Jan. 1, 2004

Related U.S. Application Data

(60) Provisional application No. 60/324,314, filed on Sep. 24, 2001.

(51) Int. Cl.[7] ..... A62B 9/00; A62B 9/02

(52) U.S. Cl. ..... 128/205.21; 128/205.24

(58) Field of Search ..... 128/205.21, 205.24, 128/201.22, 201.29, 201.23; 137/499, 68.29, 68.3, 907, 908; 222/5

(56) References Cited

U.S. PATENT DOCUMENTS 3,762,407 A * 10/1973 Shonerd ..... 128/201.23
3,776,227 A * 12/1973 Pitesky et al. ..... 128/205.21
3,976,063 A * 8/1976 Henneman et al. .... 128/201.25
4,083,187 A * 4/1978 Nagashima ..... 60/407
4,365,628 A * 12/1982 Hodel ..... 128/205.12
4,887,591 A * 12/1989 Okumura ..... 128/205.21
5,488,946 A * 2/1996 Calhoun et al. ..... 128/205.21
6,155,258 A * 12/2000 Voege ..... 128/205.21
6,247,471 B1 6/2001 Bower et al. ..... 128/205.21
6,260,570 B1 * 7/2001 Wass et al. ..... 137/68.3

* cited by examiner

*Primary Examiner*—Henry Bennett
*Assistant Examiner*—Mital Patel
(74) *Attorney, Agent, or Firm*—Peter S. Gilster; Greensfelder, Hemker & Cale, P.C.

(57) ABSTRACT

Control valve (10) for a user-donnable breathing device selectively switches from a normal breathing oxygen source to a pressurized emergency bottle. A valve body (12) has a normal oxygen source inlet and also an emergency source inlet for oxygen flow to the user of the device when donned. A poppet (30) permits normal source oxygen flow into the valve body (12), normally keeping a piston (32) in a spring-biased cocked position spaced from a seal of the emergency bottle. A user-operated release permits the poppet to move to a position for blocking the normal source inlet but allowing the piston to become uncocked and so be driven by spring force to pierce the emergency bottle seal. Only emergency breathing oxygen from the bottle then flows to the user for emergency breathing. The device can be an escape hood for an aircraft passenger.

7 Claims, 4 Drawing Sheets

VALVE ASSEMBLY FOR BREATHING SYSTEMS

CROSS-REFERENCE TO RELATED APPLICATION

This application is based upon and claims the priority of provisional application Ser. No. 60/324,314, filed Sep. 24, 2001, entitled Valve Assembly for Breathing Systems of the present inventors, which is incorporated by reference. Continued preservation of said provisional application is requested.

BACKGROUND OF THE INVENTION

1. Field of the Invention

The present invention relates to emergency breathing systems including user-donnable breathing hoods for supplying breathing oxygen to a user as for escape from an aircraft, and, more specifically, to a control valve for such a system for selectively switching from normal breathing oxygen such as the aircraft oxygen supply to a pressurized emergency source of breathing oxygen.

2. Known Art

Oxygen supply devices are desirable for emergency situation, particularly by crew or passengers in aircraft. More specifically, oxygen supply devices that not only supply breathing oxygen from a plumbed source such as the drop-down "DIXIE" cup construction disclosed in Jumpertz U.S. Pat. No. 5,301,665. An advance in the art relating to these devices is disclosed in Bower et al. U.S. Pat. No. 6,247,471 which is incorporated in its entirety by reference.

In aircraft, emergency oxygen supply devices employing the presently inventive apparatus are to be tightly bundled to fit within a compartment above the seats of aircraft passengers. Upon encountering a situation such as a reduced cabin pressure condition, a door to the compartment opens and the oxygen supply device drops down and dangles by a flexible hose which is connected to a plumbed breathing oxygen source in the aircraft. The seated aircraft passenger then dons a breathing hood which is included with the device to begin receiving oxygen from the plumbed oxygen source. The passengers continue to receive oxygen in this fashion until instructed by a crewmember to pull a lanyard that is connected to the device which not only disconnects the passenger from the plumbed oxygen source but activates a portable emergency oxygen source. This oxygen source is a 3,000 psi bottle of compact construction which inflates the breathing hood with an oxygen mixture to provide the aircraft passenger with enough breathing oxygen to leave his seat and escape from the aircraft.

The present invention relates to an improvement to the control valve in an oxygen supply device which operates with fewer moving parts for high reliability, manufacturability, and compactness.

SUMMARY OF THE INVENTION

Among the objects, advantages and features of the present invention are to provide an improved control valve having fewer moving parts for compactness and improved manufacturability.

Another object is to provide the improved valve which has very high reliability of operation.

Briefly, for use in a system including a user-donnable breathing device for supplying breathing oxygen to a user of the device, the improvement comprises a control valve for selectively switching from a normal source of the breathing oxygen to a pressurized emergency source of breathing oxygen associated with the breathing device. The control valve includes a valve body having a normal source inlet, an emergency source inlet, and a delivery outlet for delivery of the breathing oxygen to the user of the breathing device when donned. The valve includes a poppet configured when in a normal connected position for permitting oxygen from the normal source to flow into the valve body and then out through the delivery outlet. A normal oxygen supply fitting associated with the normal source inlet is provided as is a releasable retention device for maintaining the poppet in its normal position. A shiftable piston is urged by a biasing force against the supply fitting. The poppet normally maintains the piston in a cocked position. A seal normally prevents flow of oxygen from the emergency source until ruptured. A seal rupturer is interposed between the piston and the seal to rupture the seal when driven by the piston when released from its cocked position. The retention device is selectively releasable by the user for permitting the poppet to move in response to urging of the piston from the normal poppet position to a flow blocking position. The retention device normally blocks the normal source inlet. When the seal is ruptured, emergency breathing oxygen flows through the valve body and the delivery outlet for user emergency breathing. An oxygen fitting normally connects the normal source of oxygen to the valve body, but is detachable from the valve body in response to movement of the poppet to the flow blocking position.

Upon user release of the retention device, the valve body and breathing device are physically disconnected from the normal oxygen source while the user is breathing emergency oxygen from the emergency source.

The breathing device may be an aircraft passenger escape hood, allowing the user to escape while the hood is filled with the emergency breathing oxygen.

Additional objects, advantages and novel features of the invention will be set forth in the following description.

The terms oxygen, breathing oxygen, or any sources of oxygen or breathing oxygen described herein may refer to pure oxygen, or any oxygen mixture that may be provided to a user as a breathing source.

BRIEF DESCRIPTION OF THE DRAWINGS

Corresponding elements are identified by corresponding numerals throughout the views.

DETAILED DESCRIPTION OF A PRACTICAL EMBODIMENT

Figure 1:
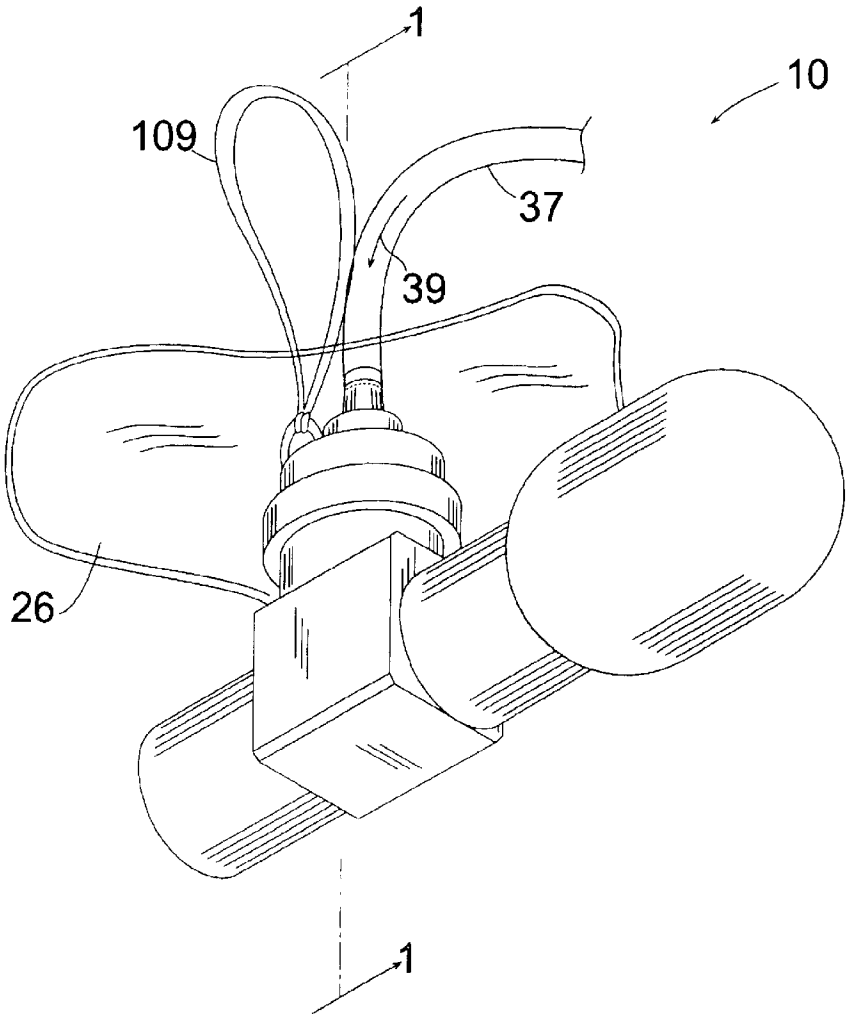
FIG. 1 is a perspective view of an improved control valve of the present invention.
Figure 2:
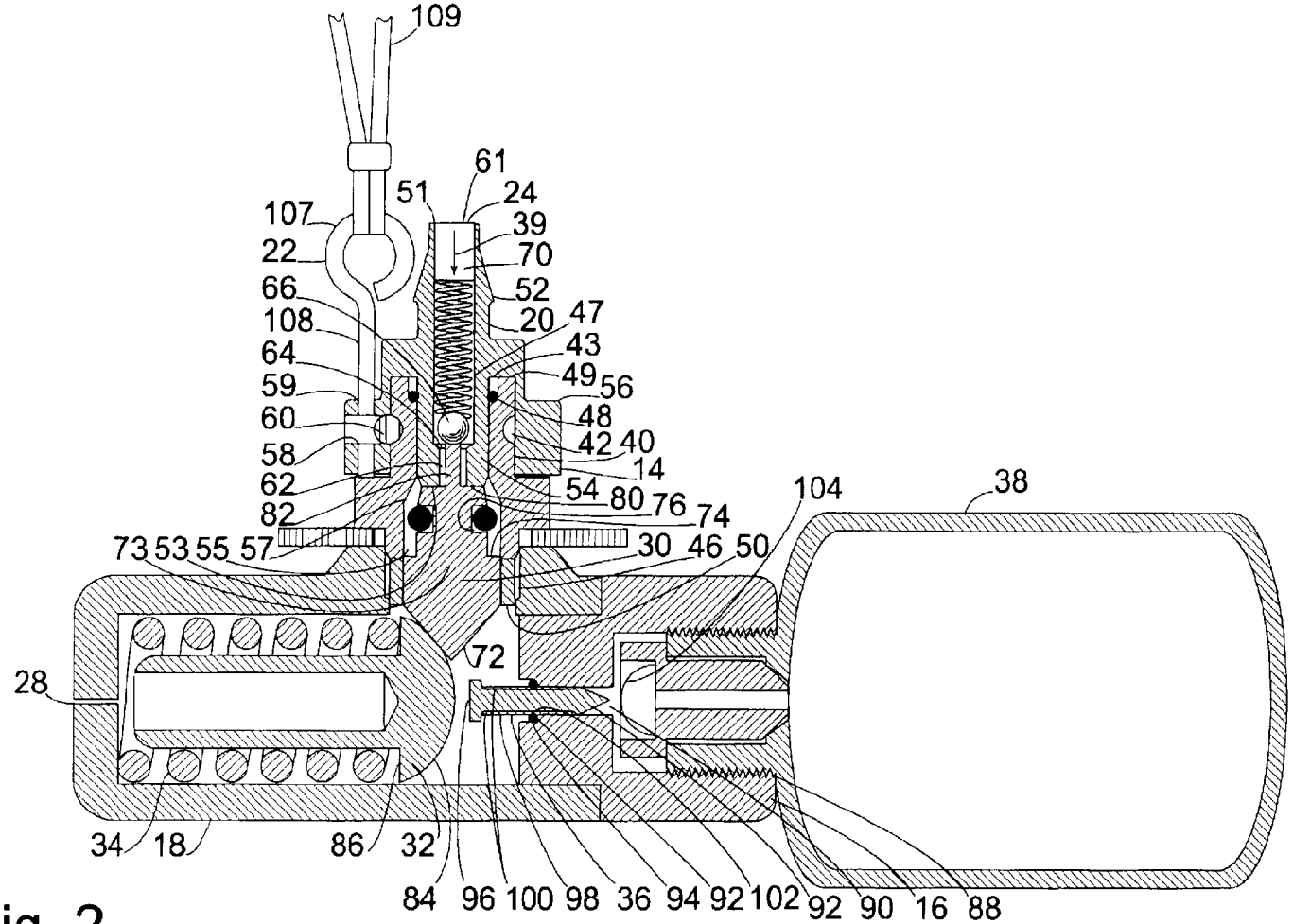
FIG. 2 is a cross sectional view taken along line 1—1 of FIG. 1 of the control valve.

Referring to FIG. 1, the control valve is generally designated 10. As shown in FIG. 2, control valve 10 includes a valve body 12 which has a disconnect fitting 14, a bottle adapter 16, and a piston housing 18. An inlet cap 20 is slideably secured to disconnect fitting 14 by a release pin 22 serving as a retention device. Inlet cap 20 is provided with an inlet 24 for providing breathing oxygen 39 from a plumbed source 37 (FIG. 1) to the wearer of a breathing hood 26 through a delivery outlet 28.

An oxygen bottle 38 becomes available to the user as a source of breathing oxygen when a piston 32 contacts and propels a piercing pin 36 into rupturing contact with a seal 104 of bottle 38. A relatively powerful compression spring 34 applies a biasing force to piston 32. Preventing inadvertent release of oxygen bottle 38 is a poppet 30 which maintains piston 32 in its cocked position, thereby preventing its movement within the valve body. Upon release of release pin 22 by the user, poppet 30, which is no longer able to keep piston 32 in its cocked position, is forcefully and rapidly driven upwardly within disconnect fitting 14 for reliably disconnecting inlet cap 20 from valve 10. Disconnecting inlet cap 20 which supplies oxygen 39 from source 37 (FIG. 1) to the user thereby terminates the flow of oxygen 39 to valve 10. Poppet 30 continues its vertical movement within valve 10 until securely wedged inside disconnect fitting 14, providing an airtight connection therein. Piston 32 then forcefully drives piercing pin 36 into rupturing contact with seal 104 of bottle 38 for providing breathable oxygen to the user.

Disconnect fitting 14 comprises a cylindrical portion 40 that is defined by a fitting facing end 49 and a body facing end 50 for providing slideable movement therein by inlet cap 20 and poppet 30. A transverse annular groove 42 is formed along the outer periphery of cylindrical portion 40 for retaining inlet cap 20 with release pin 22 and a locking ball 60 normally held in a seated position by release pin 22. An aperture 47 which extends longitudinally from end 49 further opens into an enlarged aperture portion 55 at a radially outwardly tapered region 57. Formed along the inner periphery of cylindrical portion 40 along end 49 is an annular recess 43 for securing an O-ring 48 therein.

Inlet cap 20 has an oxygen source facing end 51 and a poppet facing end 53. Extending longitudinally from end 51 is a nipple 52 for connecting with the plumbed source.

Nipple 52 transitions to an inner cylindrical portion 54 and an outer cylindrical portion 56 for making slideable contact over portion 40 of disconnect fitting 14. A radially directed aperture 58 is formed in portion 56 for placing lock ball 60 in annular groove 42 when aperture 58 and groove 42 are aligned. A longitudinal aperture 59 formed in portion 56 intersects aperture 58 for receiving release pin 22 therein which maintains lock ball 60 within groove 42 to maintain a fixed fitting relationship between inlet cap 20 and disconnect fitting 14. Inlet 24, which is formed in inlet cap 20 for providing a passage for flow of oxygen 39, defines an aperture 61 which transitions at seat 64 to further define a reduced diameter region 62. A check ball 66 is inserted in aperture 61 from end 51 so that check ball 66 may rest along seat 64 for blocking the flow of oxygen 39 from plumbed source 37 (FIG. 1). Therefore, upon disconnection of fitting 14, the aircraft system then is securely blocked through line 37 to maintain pressure in the aircraft oxygen system without possibility of leakage from fitting 14. A spring 68 is interposed between ball 66 and a filter 70 which filters oxygen 39 in aperture 61 so that spring 68 will urge check ball 66 toward seat 64. Preferably, filter 70 is comprised of sintered bronze. Filter 70 prevents any possibility that particles of troublesome size in the aircraft oxygen system would enter valve 10.

Removing release pin 22 from the valve which switches oxygen sources from source 39 to bottle 38 includes a loop 107 that transitions into a shaft 108. A lanyard 109 is secured to loop 107 to allow a user to cause removal of release pin 22 from valve 10. A release force of approximately ten pounds is preferably required to slideably remove shaft 108 from aperture 59. Preferably, release pin 22 is constructed of a rigid alloy such as music wire that is electrochemically compatible with inlet cap 20 and provides a relatively low desired static coefficient of friction with fitting 20 to cause the desired release force.

Poppet 30 comprises a beveled end 72 for making sliding contact with a rounded head 84 of piston 32 for maintaining piston 32 in a cocked position. End 72 which preferably forms a ninety degree included angle 73 transitions into a shoulder 74 and further transitions into a recessed region 76 for securing an O-ring 78 therein. Upon removal of release pin 22, shoulder 74 wedges into tapered region 57 of disconnect fitting 14 so that poppet 30 provides an airtight seal within aperture 47 as will be discussed in greater detail below. Recessed region 76 transitions into a shoulder 80 for abutting end 53 of inlet cap 20. A pin 82 extends from shoulder 80 for insertion into region 62 for moving ball 66 in a direction away from seat 64 to permit the flow of breathing oxygen from source 39.

Piston 32 which is slideably movable within body housing 18 includes head 84 for contacting end 72 of poppet 30. Once piston 32 is propelled past poppet 30, head 84 then rams piercing pin 36 into rupturing contact with bottle 38. A shoulder 86 is opposite head 84 for contacting powerful spring 34. Spring 34 which is interposed between shoulder 86 and body housing 18 biases piston 32 in its cocked position with a force preferably between 80 and 100 pounds and may be a helical compression spring, foam, an electric motor, a compressed gas, a mechanical motor, a series of belleville washers, an explosion, or any other source that may provide a sufficient driving force to propel piston 32 within valve 10 to accomplish the result described herein. This description is also applicable to spring 68.

Bottle adapter 16 includes a threaded opening 88 for threadedly engaging bottle 38. Opening 88 transitions to a reduced delivery opening 90 and terminates at a recessed region 92 for receiving an O-ring 94 therein. Piercing pin 36 for rupturing seal 104 of bottle 38 preferably includes a head 96 which transitions into a shaft 98 that is slideably receivable within opening 90, terminating in a sharpened end 102 for rupturing seal 104. Piercing pin 36 is preferably comprised of a nickel-aluminum-bronze alloy for its increased stiffness and strength over brass. Shaft 98 is provided with a transverse groove 106 that receives O-ring 94 for securing piercing pin 36 in position within opening 90. A pair of opposed longitudinal grooves 100 are formed along shaft 98 for providing a passage between piercing pin 36 and opening 90 to permit flow from bottle 38 after sharpened end 102 has ruptured seal 104. It is appreciated that pin 36 may be a sharpened pin, a blunt pin, an explosive charge, or any other type of electrical, mechanical, pneumatic construction, may cause an aural signal to alert the user and crew that the user has activated the device, severing its connection with the aircraft system that could accomplish the result described herein.

Referring to FIGS. 1–4, the operation of valve 10 is as follows: In its initially packaged condition, plumbed source 37 is slid over nipple 52 to provide oxygen 39 to the user of breathing device 26. Normally, oxygen 39 passes into inlet 24, proceeds past ball 66 and seat 64, through region 62, and around both poppet 30 and piston 32 for being delivered to the user through delivery outlet 28. Also in the normal condition, spring 34 is in a compressed or cocked position for forcibly driving piston 32 within the valve, but piston 32 is held in its cocked position by end 72 of poppet 30. Poppet 30 is secured in its fixed position by inlet cap 20 that is secured in a fixed position to disconnect fitting 14 by release pin 22 and lock ball 60.

Figure 3:
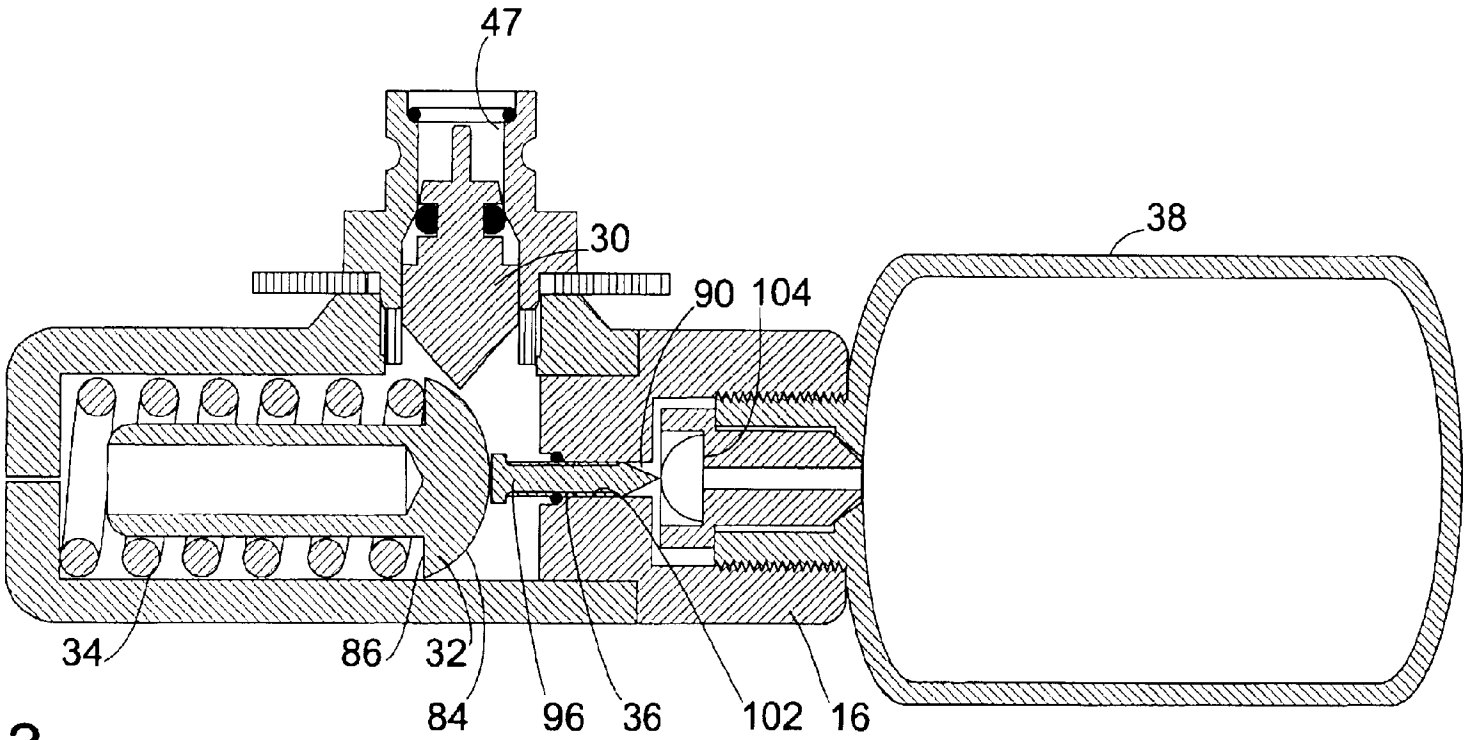
FIG. 3 is a cross sectional view taken along line 1—1 of FIG. 1 of a sequence of operation of the valve once the retaining device is removed.

Upon removal of release pin 22, by the user's pulling of lanyard 109 with sufficient force to slide shaft 108 out of aperture 59, lock ball 60 that rested in annular groove 42 simply rolls out of aperture 58. Without lock ball 60 to retain inlet cap 20 in position, powerful compressed spring 34 begins to expand longitudinally toward bottle 38 which urges shoulder 86 of piston 32 to cause head 84 to slide relative to end 72 of poppet 30 thereby forcing poppet 30 in an accelerated vertical movement as shown in FIG. 3. As poppet 30 continues to rapidly move in a vertical direction, due to the abutting contact between end 53 of inlet cap 20 and shoulder 80 of poppet 30, inlet cap 20 is also forcefully driven in a vertical direction and is reliably separated from valve 10 as also shown in FIG. 3. Additionally, head 84 rams into head 96 of piercing pin 36 thereby forcefully driving sharpened end 102 toward seal 104 of bottle 38.

Figure 4:
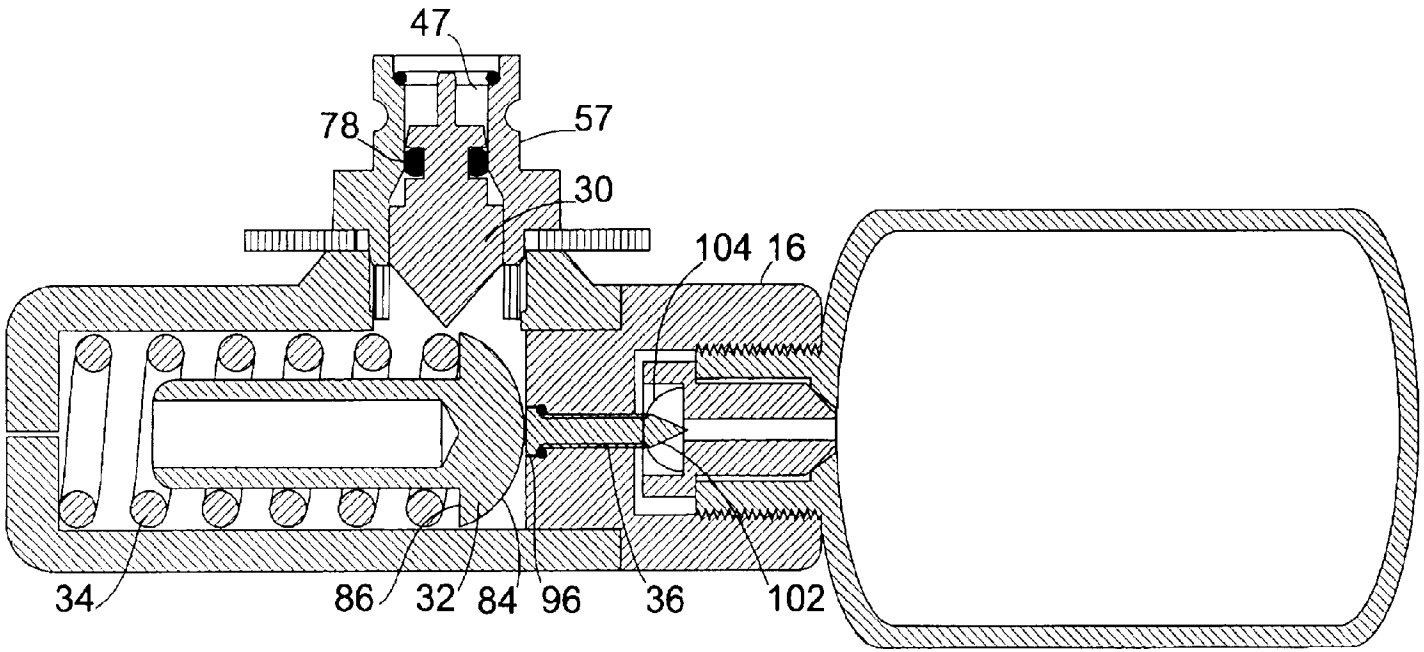
FIG. 4 is a cross sectional view taken along line 1—1 of FIG. 1 of a further sequence of operation of the valve after the retaining device is removed.

Referring to FIG. 4, head 84 of piston 32 continues to rapidly drive poppet 30 in a vertical direction until shoulder 74 abruptly wedges against tapered region 57 and O-ring 78 makes full peripheral contact with aperture 47 to form an airtight seal therewith. Piston 32 is continuously driven by spring 34 until head 96 of piercing pin 36 abuts bottle adapter 16 and seal 104 is ruptured for providing oxygen from bottle 38 to the user through delivery outlet 28.

In view of the foregoing description of the present invention and various embodiments and methods it will be seen that the several objects of the invention are achieved and other advantages are attained.

Although the valve body components and other components in communication with a high pressure oxygen flow are preferably comprised of brass due to its superior properties in oxygen fires, especially bottle adapter 16 and piston 32, aluminum alloys may also be used. Further, springs 34, 68 may be comprised of stainless steel or other materials capable of providing the required high biasing forces and being compatible with breathing oxygen systems.

It can be appreciated that the valve which is used with a breathing hood that encloses the user's head may also be used with any other breathing device configuration that provides breathing oxygen to the user.

The embodiments were chosen and described to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. For use in a system including a user-donnable breathing device for supplying breathing oxygen to a user of the device, the improvement comprising:

a control valve for selectively switching from a normal source of the breathing oxygen to a pressurized emergency source of breathing oxygen associated with the device, the control valve including:

a valve body having a normal source inlet, an emergency source inlet, and a delivery outlet for delivery of the breathing oxygen to the user of the device when donned;

the valve including a poppet configured when in a normal position for permitting oxygen from the normal source to flow into the valve body and then out through the delivery outlet;

a normal oxygen supply fitting associated with the normal source inlet;

a releasable retention device for maintaining the poppet in its normal position;

a cocked piston normally occupying a cocked position and shiftable when released from its cocked position for being urged against the supply fitting, a drive device biasing the piston in its cocked position for urging the piston against the poppet to maintain the cocked position, the poppet normally preventing the piston from being driven from the cocked position by the drive device, a seal for normally preventing flow of oxygen from the emergency source until ruptured;

a rupturer interposed between the piston and the seal to rupture the seal by being driven by the piston when released from its cocked position;

the retention device being selectively releasable by the user, the retention device when released permitting the poppet to move, in response to urging of the piston, from the normal poppet position to a flow blocking poppet position, so as to block the normal source inlet and to allow the piston to be driven against the rupturer;

the seal when ruptured permitting the emergency breathing oxygen to flow through the valve body and then through the delivery outlet for user emergency breathing.

2. The control valve of claim 1 wherein the normal oxygen supply fitting is attached to the valve body for normally connecting the normal source of oxygen to the valve body is detachable from the valve body in response to movement of the poppet to the flow blocking position;

whereby the valve body and device are physically disconnected from the normal oxygen source while the user is breathing emergency oxygen from the emergency source.

3. A control valve for selectively switching from providing a breathable primary gas from a primary gas source to a breathing gas outlet, to providing a breathable secondary gas from a secondary gas source to the outlet, the valve comprising:

a body including a first inlet, a second inlet and an outlet, the first inlet and the outlet being normally in fluid communication;

an end fitting removably disposed over the first inlet, the end fitting connected to the primary gas source, the second inlet connected to the secondary gas source;

a retention device securing the end fitting to the first inlet;

a flow control device disposed in relation to the secondary gas source for normally preventing a flow of the secondary gas source;

a poppet adjacent the end fitting;

a piston fitted within the body;

a biasing means for biasing the piston into contact with the poppet;

the piston normally positioned in a cocked position to one side of the poppet, the piston being normally maintained in said cocked position by the poppet, the piston being shiftably released from its cocked position by the poppet when permitted by the poppet;

wherein upon removal of the retention device from the valve, the poppet permits the piston to be uncocked so that the piston is driven forcefully and rapidly from its cocked position by the biasing means in a direction toward the flow control device, forces the poppet toward the first inlet for stopping the flow of the primary gas through the first inlet, and forcefully actuates the flow control device in response to the biasing means to permit the secondary gas to flow from the secondary gas source.

4. The control valve of claim 3 the breathable primary gas from a primary gas source is a plumbed primary oxygen gas source in a passenger transportation device and the secondary gas is an emergency source of breathing oxygen, and the outlet supplies breathing oxygen to a user-donnable breathing device for use both within, and during escape from the transportation device.

5. The control valve of claim 4 further comprising a lanyard connecting the control valve device to structure associated with the primary gas source, the lanyard being operative to disconnect the control valve from the primary gas source, and to activate the retention device when a user pulls against the lanyard during escape.

6. For use in an emergency breathing system including a user-donnable breathing device for supplying breathing oxygen to a user of the breathing device:

a control for selectively switching from a normal source of the breathing oxygen to a pressurized emergency source of breathing oxygen associated with the device, the control including;

a normal source inlet, an emergency source inlet, and a delivery outlet for delivery of the breathing oxygen to the user of the breathing device when donned;

the control including a valve body carrying therein a cocked control element when in a cocked position permitting oxygen to flow from the normal source into the control and then out through the delivery outlet;

a releasable retention device for maintaining the control element in its cocked position;

a drive element urging the control element against the retention device , the retention device normally preventing the control element from being driven from its cocked position by the drive element;

a seal for normally preventing flow of oxygen from the emergency source until ruptured;

rupturing means interposed between the control element and the seal for rupturing the seal by being driven by the control element when released from its cocked position;

the retention device being selectively releasable by the user, the retention device when released permitting the control element to move in response to the drive element from its cocked position to an uncocked emergency position which blocks the normal source inlet and instead bears against the rupturing means;

the seal when ruptured permitting the emergency breathing oxygen to flow through the valve body and then through the delivery outlet for user emergency breathing.

7. For use in an emergency breathing system including a user-donnable breathing device for supplying breathing oxygen to a user of the breathing device and escape use of the breathing device while supplying emergency breathing oxygen to the user:

a control for selectively switching in an emergency from a normal source of the breathing oxygen to a pressurized emergency source of breathing oxygen associated with the device, the control including;

a normal source inlet, an emergency source inlet, and a delivery outlet for delivery of the breathing oxygen to the user of the breathing device when donned;

the control including a valve body carrying therein a cocked control element when in a cocked position permitting oxygen to flow from the normal source into the control and then out through the delivery outlet;

a releasable retention device for maintaining the control element in its cocked position;

a drive element urging the control element against the retention device, the retention device normally preventing the control element from being driven from its cocked position by the drive element;

a seal for normally preventing flow of oxygen from the emergency source until ruptured;

rupturing means interposed between the control element and the seal for rupturing the seal by being driven by the control element when released from its cocked position;

the retention device being selectively releasable by the user, the retention device when released permitting the control element to move in response to the drive element from its cocked position to an uncocked emergency position which blocks the normal source inlet and instead bears against the rupturing means;

the seal when ruptured permitting only the emergency breathing oxygen to flow through the valve body and then through the delivery outlet for user emergency breathing.

* * * * *